US012638253B2

(12) United States Patent
Sakaray et al.

(10) Patent No.: US 12,638,253 B2
(45) Date of Patent: May 26, 2026

(54) MODULARIZED THERMAL MANAGEMENT

(71) Applicant: Caterpillar Inc., Peoria, IL (US)

(72) Inventors: Umakanth Sakaray, Dunlap, IL (US); Pavan Kumar Reddy Kudumula, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 294 days.

(21) Appl. No.: 18/221,410

(22) Filed: Jul. 13, 2023

(65) Prior Publication Data

US 2025/0020418 A1 Jan. 16, 2025

(51) Int. Cl.
*F28F 9/00* (2006.01)
*E04H 5/04* (2006.01)

(52) U.S. Cl.
CPC ..... *F28F 9/002* (2013.01); *E04H 5/04* (2013.01); *F28F 2009/004* (2013.01); *F28F 2280/02* (2013.01); *F28F 2280/06* (2013.01)

(58) Field of Classification Search
CPC ..... F28F 9/02; F28F 9/002; F28F 2280/06; F28F 2009/004; F25D 19/04; E04H 5/04; H05K 7/2079
See application file for complete search history.

(56) References Cited

U.S. PATENT DOCUMENTS 4,449,764 A * 5/1984 Hastings ..... E05G 7/00 261/106
9,777,971 B2 10/2017 Nagurny et al.
11,140,799 B2 10/2021 Gao
11,512,900 B2 11/2022 Bugler et al.
2008/0291626 A1* 11/2008 Nelson ..... H05K 7/2079 361/696
2009/0073658 A1* 3/2009 Balcerak ..... H01F 27/10 264/177.17
2010/0307716 A1* 12/2010 Bean, Jr. ..... H05K 7/20745 165/80.2
2014/0239990 A1* 8/2014 Steiger ..... G01R 31/62 324/750.03
2015/0048950 A1* 2/2015 Zeighami ..... H05K 7/2079 340/618
2022/0167523 A1* 5/2022 Dumas ..... H05K 7/20172
(Continued)

FOREIGN PATENT DOCUMENTS

EP 1586841 A2 * 10/2005 ..... F28D 5/02
KR 20010015060 A * 2/2001

OTHER PUBLICATIONS

Translation of KR20010015060A named Translation-KR20010015060A (Year: 2001).*

*Primary Examiner* — Paul Alvare
(74) *Attorney, Agent, or Firm* — Xsensus LLC

(57) ABSTRACT

A thermal management system for an exothermic process includes cooling units, each including a hot coolant port through which coolant heated by the exothermic process flows and a cold coolant port through which the coolant that has been heat reduced by the cooling units flows. A pair of mounting rails have respective interior chambers that are in fluid communication with corresponding coolant ports formed on the respective mounting rails. Conduits interconnect the coolant port of one of the mounting rails to the hot coolant port of each of the cooling units and the coolant port of the other one of the mounting rails to the cold coolant port of each of the cooling units.

19 Claims, 6 Drawing Sheets

(56) References Cited

U.S. PATENT DOCUMENTS

| | | | | |
|---|---|---|---|---|
| 2023/0008636 | A1 | 1/2023 | Heydari | |
| 2023/0240054 | A1* | 7/2023 | Neuman | H05K 7/20272 |
| 2025/0075986 | A1* | 3/2025 | Elliott | F28D 1/05366 |

* cited by examiner

MODULARIZED THERMAL MANAGEMENT

TECHNICAL FIELD

The present disclosure generally relates to thermal management primarily of exothermic processes. More specifically, the present disclosure describes modularized cooling systems.

BACKGROUND

Modularization provides multiple benefits in a wide range of applications. Among other things, modularization simplifies designs and affords system scalability through, for example, replication of similar, or even identical modules. As used herein, the term "module" is intended to refer to any one of a set of standardized subsystems or components that mechanically interconnect into a more complex structure, referred to herein as a "modularized" system. These advantages are certainly extended to the field of thermal management, where demands for increased cooling capacity can be met by adding supplementary cooling units.

One example of thermal management modularization is described in U.S. Pat. No. 11,140,799, which is directed to an inrow (as it is referred to in the reference) liquid cooling module for high density electronics racks of a data center. The disclosed cooling module transfers heat away from one or more pieces of liquid cooled, rack mounted information technology (IT) equipment. Each cooling module implements a distribution manifold in which one or more secondary liquid coolant loops are disposed around the IT equipment and a primary coolant loop is formed with a primary coolant source. As pieces of IT equipment are added to an equipment rack, a corresponding cooling module can be added.

U.S. Pat. No. 11,512,990 is directed to an advanced large scale field-erected air cooled industrial steam condenser. The document discloses heat exchanger panels of an air cooled condenser (ACC) into which uncondensed steam and non-condensable fluid flow are drawn and from which condensate is drawn off and sent to join water already collected. Each heat exchanger panel may be independently loaded into and supported by a framework that includes steam distribution ductwork. Adjacent heat exchanger panels may be inclined to resemble an A-frame or V-frame.

U.S. Pat. No. 9,777,971 discloses a modular heat exchanger in an ocean thermal energy conversion (OTEC) context. The heat exchangers described comprise modules for conveying primary fluid through the heat exchanger, wherein the modules are individually removable. As a result, each module can be easily repaired, replaced, and/or refurbished. The modules may be fabricated from materials that are non-corrosive with respect to seawater or from materials that are subject to corrosion with respect to seawater, but these materials are isolated from seawater during use.

As demonstrated by these references, thermal management modularization typically involves deploying thermal management modules (or "units") on a structural framework and providing a working fluid (e.g., coolant) to and from the thermal management modules through a distribution network. Each of these subsystems, thermal management modules, structural framework and working fluid distribution network, may be complex in themselves, but interfacing these subsystems into an integral thermal management system introduces additional complexity. Accordingly, research, engineering and product development efforts to mitigate these system complexities are ongoing.

SUMMARY

In one aspect of the present inventive concept, a thermal management system for an exothermic process includes cooling units, each including a hot coolant port through which coolant heated by the exothermic process flows and a cold coolant port through which the coolant that has been heat reduced by the cooling units flows. A pair of mounting rails have respective interior chambers that are in fluid communication with corresponding coolant ports formed on the respective mounting rails. Conduits interconnect the coolant port of one of the mounting rails to the hot coolant port of each of the cooling units and the coolant port of the other one of the mounting rails to the cold coolant port of each of the cooling units.

In another aspect of the present inventive concept, a thermal management system for an exothermic apparatus includes a hot coolant port through which heated coolant is delivered to the thermal management system and a cold coolant port through which heat reduced coolant is delivered from the thermal management system. The thermal management system includes cooling units constructed to transfer heat from the heated coolant delivered through the hot coolant port of the exothermic apparatus and to provide the resulting heat reduced coolant to the cold coolant port of the exothermic apparatus. A pair of mounting rails are constructed to support the cooling units mechanically attached thereto, the mounting rails have respective interior chambers constructed to contain the heated coolant in one of the mounting rails and the heat reduced coolant in the other one of the mounting rails. Conduits interconnect the respective mounting rails to the corresponding hot coolant port and the cold coolant port of the exothermic apparatus.

DESCRIPTION OF EXAMPLE EMBODIMENTS

Figure 1:
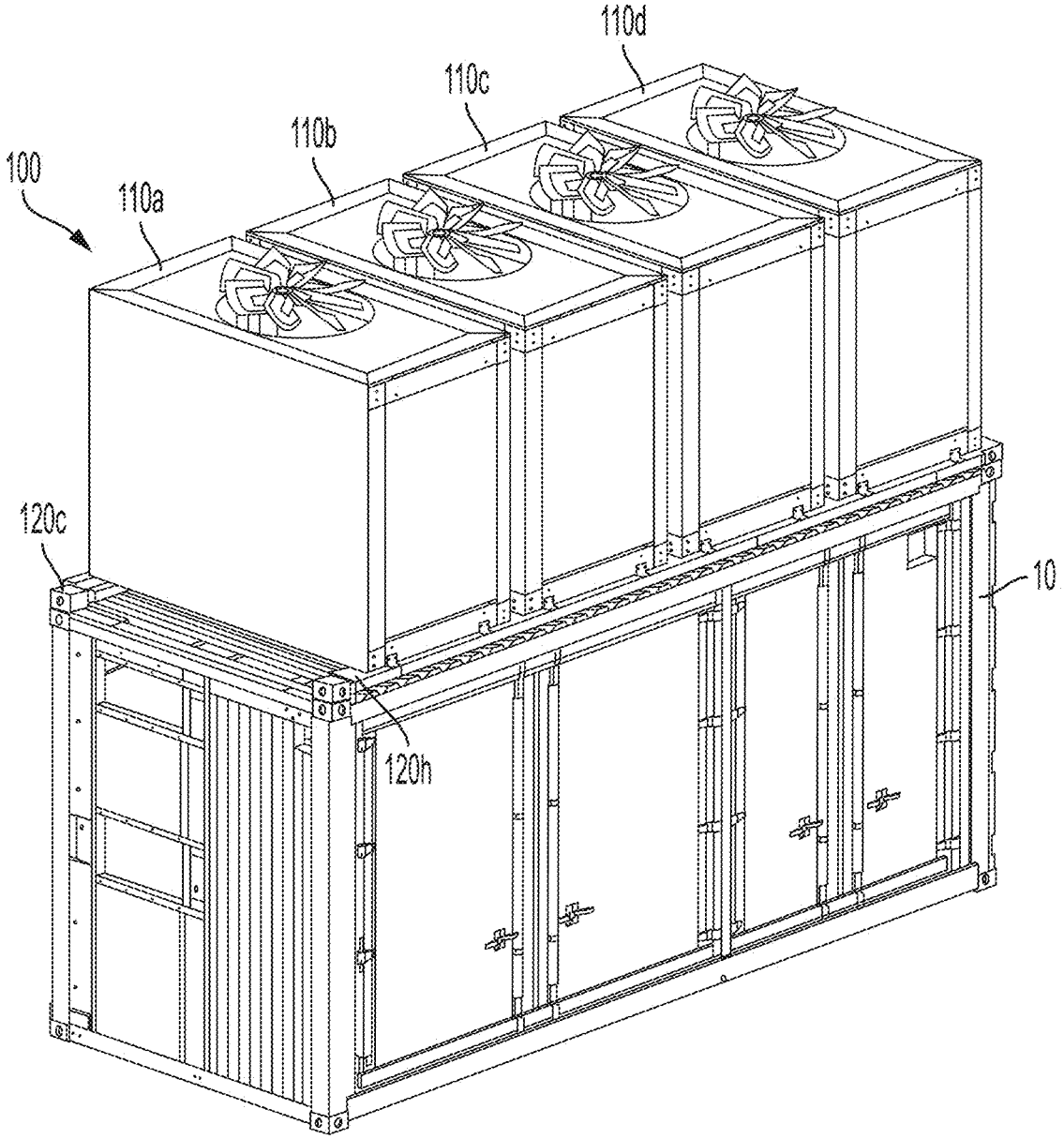
FIG. 1 is an illustration of an exemplary thermal management system deployed on a standalone power generation station as an example embodiment of the present inventive concept.

The present inventive concept is best described through certain embodiments thereof, which are described in detail herein with reference to the accompanying drawings, wherein like reference numerals refer to like features throughout. It is to be understood that the term invention, invention, when used herein, is intended to connote the inventive concept underlying the embodiments described below and not merely the embodiments themselves. It is to be understood further that the general inventive concept is not limited to the illustrative embodiments described below and the following descriptions should be read in such light.

Additionally, the word exemplary is used herein to mean, "serving as an example, instance or illustration." Any embodiment of construction, process, design, technique, etc., designated herein as exemplary is not necessarily to be construed as preferred or advantageous over other such embodiments.

The figures described herein include schematic block diagrams illustrating various interoperating functional modules. Such diagrams are not intended to serve as mechanical or electrical schematics and interconnections illustrated are intended to depict signal/fluid flow, various interoperations between functional components and/or processes and are not necessarily direct mechanical or electrical connections between such components. Moreover, the functionality illustrated and described via separate components need not be distributed as shown, and the discrete blocks in the diagrams are not necessarily intended to depict discrete mechanical/electrical components.

The techniques described herein are directed to modularized thermal management. While the examples described below relate to thermal management using cooling modules, skilled artisans will recognize other modularized thermal management contexts in which the present inventive concept can be applied without departing from the spirit and intended scope of the present inventive concept.

FIG. 1 is an illustration of an exemplary thermal management system 100 deployed on a standalone power generation station 10, referred to herein simply as power station 10, as an example embodiment of the present inventive concept. Thermal management system 100 may be modularized in that it may include one or more cooling units 110*a*-110*d*, representatively referred to herein as cooling unit(s) 110, each attached to a pair of mounting rails 120*h* and 120*c*. As will be described in more detail below, mounting rails 120*h* and 120*c* may serve multiple functions for embodiments of the present inventive concept. First, mounting rails 120*h* and 120*c* may be adapted to attach to power generation station 10 (and other exothermic devices) so that no special tools beyond those generally used in the specific context are needed to couple and decouple thermal management system 100 to and from power system 10. Moreover, mounting rails 120*h* and 120*c* may provide mechanisms for attaching cooling units 110 thereto. Additionally, mounting rails 120*h* and 120*c* may be hollow (see description of FIG. 4) to act as a conduit or manifold to carry coolant across cooling units 110. As one example, mounting rail 120*h* may carry hot coolant throughout thermal management system 100 and mounting rail 120*h* may carry cold coolant throughout thermal management system 100. As used herein, the terms "hot" and "cold" are used to distinguish relative temperatures and not as an indicator of actual temperature. For example, hot coolant is intended to refer to the coolant that has been heated by exothermic processes of power station 10 and cold coolant is intended to refer to the coolant that has been heat reduced by the cooling units 110.

Figure 2:
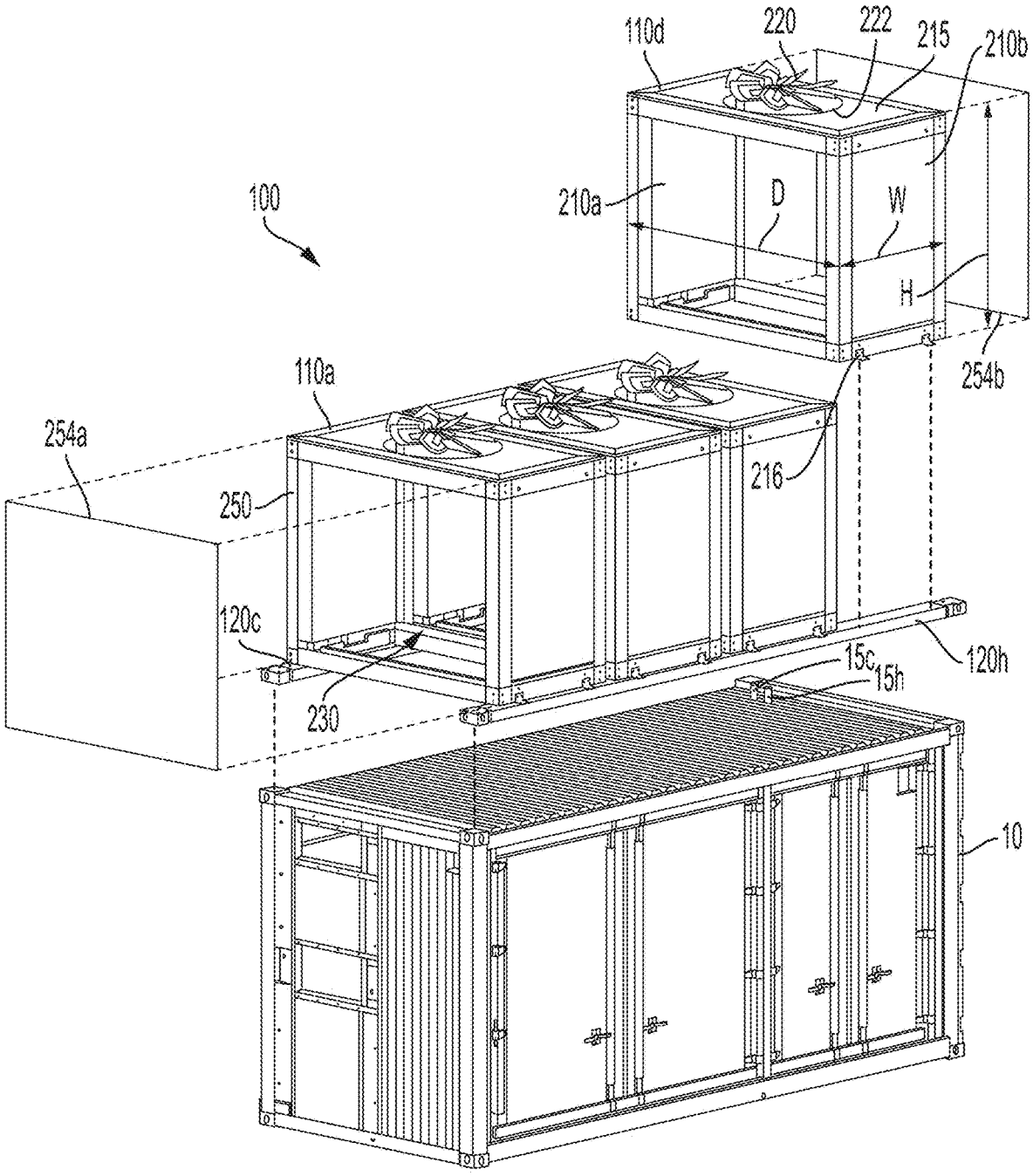
FIG. 2 is an exploded view of the exemplary thermal management system depicted in FIG. 1.

FIG. 2 is an exploded view of exemplary thermal management system 100 deployed on power station 10, which, in the illustrated example, is a fuel cell power generation station in an International Organization for Standardization (ISO) Standard 668 compliant freight container format, but skilled artisans will recognize many other energy conversion devices that produce heat in the process. Heat may be conveyed away from the system, e.g., power station 10, in a coolant fluid, referred to herein simply as coolant, provided at a hot coolant port 15*h* and returned to power station 10 subsequently to cooling by thermal management system 100 through cold coolant port 15*c*.

As indicated above, thermal management system 100 may be modularized through individual cooling units 110 mechanically coupled to both mounting rails 120*h* and 120*c*. Each cooling unit 110 may include a structural frame 250 that supports its functional components. The present inventive concept is not limited to materials or cross-sectional profiles of support elements of structural frame 250 provided such support elements, as connected together in frame 250, provide sufficient mechanical support to the components of cooling units 110 through the rigors of continuous cooling.

Support frame 250 may be constructed or otherwise configured to support a pair of radiators 210*a* and 210*b*, representatively referred to herein as radiator(s) 210, separated by a distance D. Each radiator 210 may be sized to meet cooling specifications for a particular exothermic apparatus or system when combined with radiators 210 in other cooling units 110. For purposes of description, each radiator 210 may be H high and W wide and constructed to dissipate heat $Q_{R_SPEC}$.

Each cooling unit 110 may include a top plate 215 that spans the distance D between radiators 210. In so doing, an open sided chamber 230 is formed interior to each cooling unit 110. Top plate 215 may have an opening 222 formed therein to accommodate a cooling fan 220. Cooling fan 220 may be constructed or otherwise configured to draw a volume V of air per unit time, e.g., $m^3$/min (CMM) that is sufficient to draw heat from fins/coils of radiators 210 at a rate commensurate with the volume of coolant contained therein at any given moment. These parameters: $Q_{R_SPEC}$, coolant flow, air flow, fan size, radiator size, among others, may be application dependent and their specifications and applications are within the grasp of those familiar with thermal management systems.

As illustrated in FIG. 2, each cooling unit 110 may be mechanically attached to mounting rails 120*h* and 120*c*, such as by clips 216 attached by welds, screws, bolts and other semipermanent and/or permanent attachment techniques known to the mechanically skilled. Mounting rails 120*h* and 120*c* may be, in turn, mechanically coupled to power station 10 through connectors at each end, which are described in more detail below. In some embodiments, cooling units 110 are mechanically coupled to power station 10 only through these end-mounted connectors, excluding the mechanical coupling of friction between the bottom surfaces of mounting rails 120*h* and 120*c* and the surface of power station 10 upon which thermal management system 100 rests. Additionally, end plates 254*a* and 254*b* may be attached to cooling units 110 that are on opposite ends of thermal management system 100 to ensure air flow through radiators 210 as opposed to through the open ends of thermal management system 100.

Figure 3A:
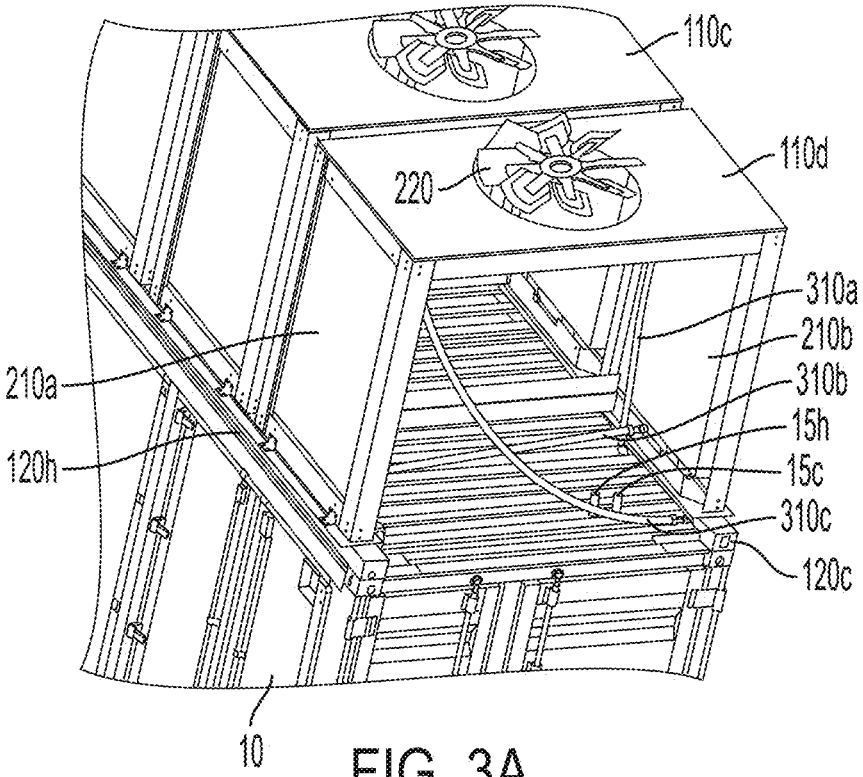
FIGS. 3A and 3B are perspective views into the interior of the exemplary thermal management system depicted in FIG. 1 to show various exemplary coolant connections.
Figure 3B:
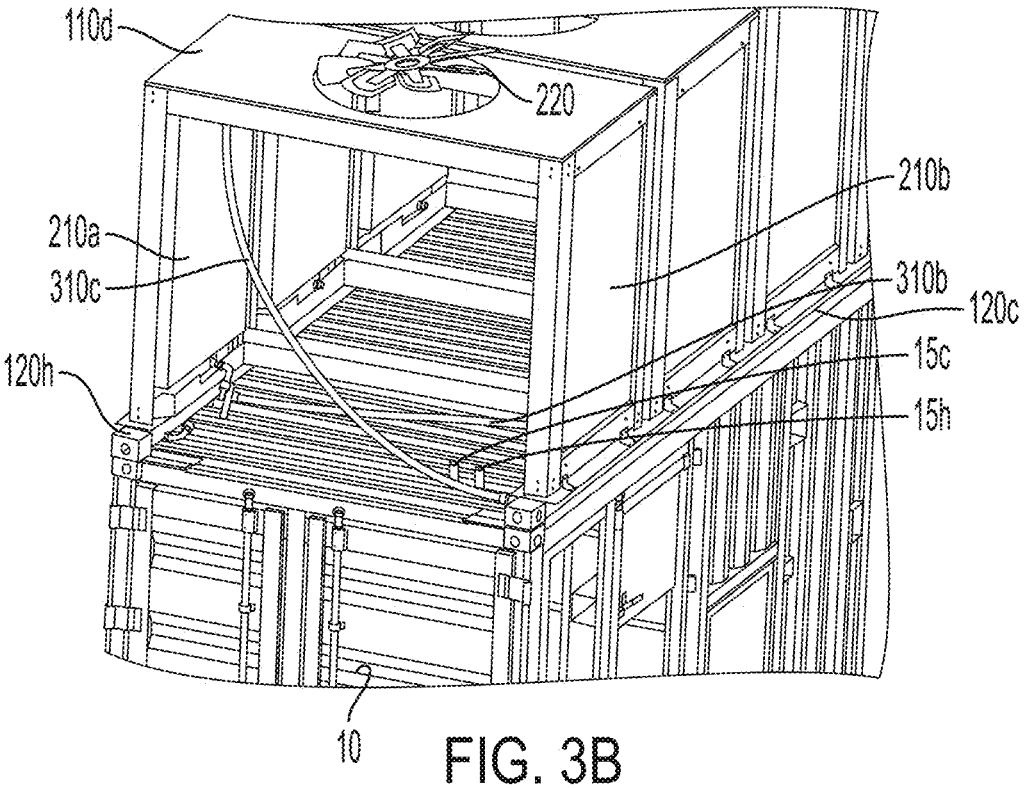

FIGS. 3A and 3B, collectively referred to herein as FIG. 3, are perspective views into the interior of thermal management system 100, i.e., with end plates 254*a* and 254*b* removed, to show various exemplary coolant connections. As indicated above and discussed in more detail with reference to FIG. 4, mounting rails 120*h* and 120*c* may have interior chambers that carry hot and cold coolant, respectively, across cooling units 110. The interior chambers (illustrated at exemplary chamber 425 in FIG. 4) may be accessed through coolant chamber ports (e.g., coolant chamber ports 417 of FIG. 4) distributed longitudinally along mounting rails 120*h* and 120*c*. Similarly, each radiator 210 may include a hot coolant port and a cold coolant port (see FIGS. 5A-5B). As illustrated in FIG. 3, a set of conduits, representatively illustrated at flexible conduits 310*a*-310*c* and referred to herein as conduit(s) 310, may interconnect the hot and cold coolant ports of radiators 210 and their respective coolant chamber ports of mounting rails 120*h* and 120*c*. It is to be understood that while the exemplary embodiments described herein utilize flexible conduits, the present inventive concept is not so limited. Example interconnections include conduit 310*a* connecting a cold coolant port of radiator 210*b* with the coolant chamber of mounting rail 120*c*, conduit 310*b* connecting a hot coolant port of radiator 210*b* with the coolant chamber of mounting rail 120*h* and conduit 310*c* connecting a cold coolant port of radiator 210*a* with the coolant chamber of mounting rail 120*c*. Further details of the internal connections of thermal management system 100 and its connections to power station 10 are provided below with reference to FIG. 5A-5B.

It is to be noted that thermal management system 100 may be made-to-order, i.e., fabricated per customer specifications from a number and cooling capacity of individual cooling units 110, assembled offsite, and transported as a unit to the site at which power station 10 is deployed. Such assembly may include installation of all conduits 310 between coolant ports on radiators 210 and corresponding coolant ports on mounting rails 120*h* and 120*c*, such as described below with reference to FIG. 5A-5B. In this configuration, onsite installation may require only mounting of thermal management system 100 onto power station 10 and fluid connections of hot coolant port 15*h* to a coolant port of mounting rail 120*h* and of cold coolant port 15*c* to a coolant port of mounting rail 120*c*. Alternatively, modularity may afford onsite assembly of thermal management system 100 including, in any order, mechanically coupling each mounting rail to power station 10, mechanically attaching cooling units 110 to mounting rails 120*h* and 120*c*, making internal fluid connections between radiators 210 and mounting rails 120*h* and 120*c* through installation of appropriate conduits 310 making external coolant connections of hot coolant port 15*h* to a coolant chamber port of mounting rail 120*h* and of cold coolant port 15*c* to a coolant chamber port of mounting rail 120*c*.

Figure 4:
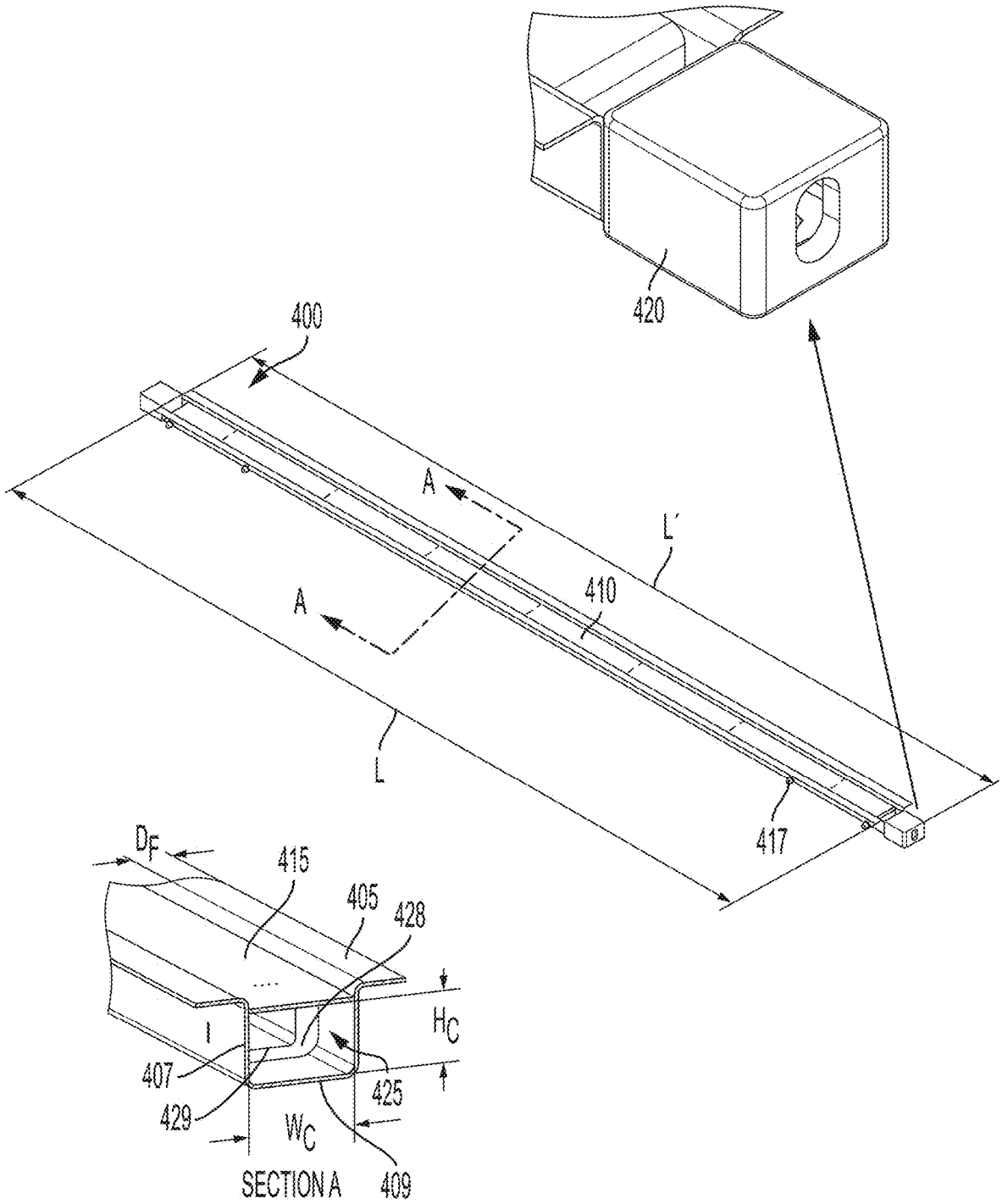
FIG. 4 is an illustration of an exemplary mounting rail that may be deployed in embodiments of the present inventive concept.

FIG. 4 is an illustration of an exemplary mounting rail 400 that may be deployed in embodiments of the present inventive concept, such as to implement mounting rails 120*h* and 120*c*. Mounting rail 400 may be designed and fabricated as a multifunctional component of thermal management system 100 combining, among other things, structural support for thermal management system 100 onto power station 10 and coolant distribution support for thermal management system 100 on behalf of power station 10 per end user specifications thereof.

Mounting rail 400 may be fabricated from a material suitable for structural support of cooling units 110 into a unitary mechanical assemblage. Mounting rail 400 may have an overall length L' that, for purposes of description, defines a longitudinal dimension. Overall length L' is used herein to denote length L of rail body 410 that separates connectors 420 disposed at each end combined with the longitudinal length of connectors 420. For example, power station 10 may have disposed at each corner thereof a male component of a quick connector of which a complementary female component may be housed in connector 420. Such a quick connector may be twist-lock mechanism for freight containers complying with international standard ISO 1161. The length L thus may be designed to register the female component of connector 420 onto its complementary counterpart on power station 10 in the longitudinal dimension. Registration of these same components in the transverse dimension (normal to longitudinal dimension) may be provided by structural frame 250 of each cooling unit 210.

As illustrated at Section A in FIG. 4, rail body 410 may define a hollow interior chamber 425 of transverse cross-sectional dimensions $H_C \times W_C$, and, with interior chamber 425 closed at both ends, of an interior chamber volume $V_C = L \times H_C \times W_C$. Coolant contained in chamber 425 may be specified by a flow rate R, that may be computed from the combined coolant flow rate through radiators 210 that, in turn, may be specified to meet thermal management specifications for power station 10. $H_C$ and $W_C$ may be selected to meet these specifications, e.g., cooling capacity sought for the implementation of power station 10, while concurrently meeting structural support goals for thermal management system 100. In one embodiment, $W_C$ may be established through a channel width of a U-channel 407, such as might be formed in metal or plastic bar material, to create a span of equal dimension $W_C$ between mounting surfaces provided by a pair of mounting flanges, representatively illustrated at mounting flange 405. As depicted in the figure, U-channel 407 and mounting flanges 405 may be fabricated as a single-piece unitary construction in suitable plastic, metal, composite, etc., bar material, but will be nevertheless described as separate elements of mounting rail body 410. Mounting flanges 405 may extend outward a distance DF from U-channel 407, which may extend beyond the periphery of cooling units 110 sufficiently to accept mounting hardware connecting individual cooling units 110 to mounting rail 400, such as clips 216 and other hardware described with reference to FIG. 2.

Transverse dimension $H_C$ of chamber 425 may be established through the location of chamber cover 415 in U-channel 407 relative to support surface 409 formed on mounting rail 400. Chamber cover 415 may be mechanically attached in U-channel 407 at the chosen location in a manner that maintains its cross-sectional U-shape and, thereby, the distance $W_C$ between mounting flanges 405, such as through adhesives, welding and other attachment techniques that are adapted for connections that are under tension. Additionally, attachment techniques may be utilized that are sufficient to seal chamber 425 against coolant leakage under system coolant pressure; although certain embodiments may apply a sealant to the interior of chamber 425 to assist in this purpose. Such a sealant may be formulated to, additionally or alternatively, limit corrosion of chamber 425 and other coolant-contacting surfaces of thermal management system 100.

Mechanically, mounting rail 400 may be functionally equivalent to other rail-type support structures by which an applicable apparatus is supported against gravity on a supporting surface, relying primarily on friction to prevent shifting on the supporting surface. As a rail-type mounting structure, the weight of cooling units 110 may be distributed across mounting flanges 405 and transferred to support surface 409, with chamber cover 415 limiting interspatial spread between mounting flanges 405. Additional support may be provided by struts, representatively illustrated at strut 428, rigidly connected to and lining the walls of chamber 425. Struts 428 may be distributed along length L of rail body 410 as needed to meet strength, rigidity and other mechanical parameters of support rails for cooling units 110, while maintaining continuous fluid communication in chamber 425 from one end thereof to the other. To that end, struts 428 may have respective openings, representatively illustrated at strut opening 429, by which simultaneous design goals of maximal support strength in mounting rail 400 and minimal coolant restriction in chamber 425 may be met.

As illustrated in FIG. 4, mounting rail 400 may include coolant chamber ports, representatively illustrated at coolant chamber port 417 that provide fluid communication with chamber 425. As such, mounting rail 400 may serve as a coolant manifold for thermal management system 100, with appropriate coolant conduit connections at coolant chamber ports 417.

Figure 5A:
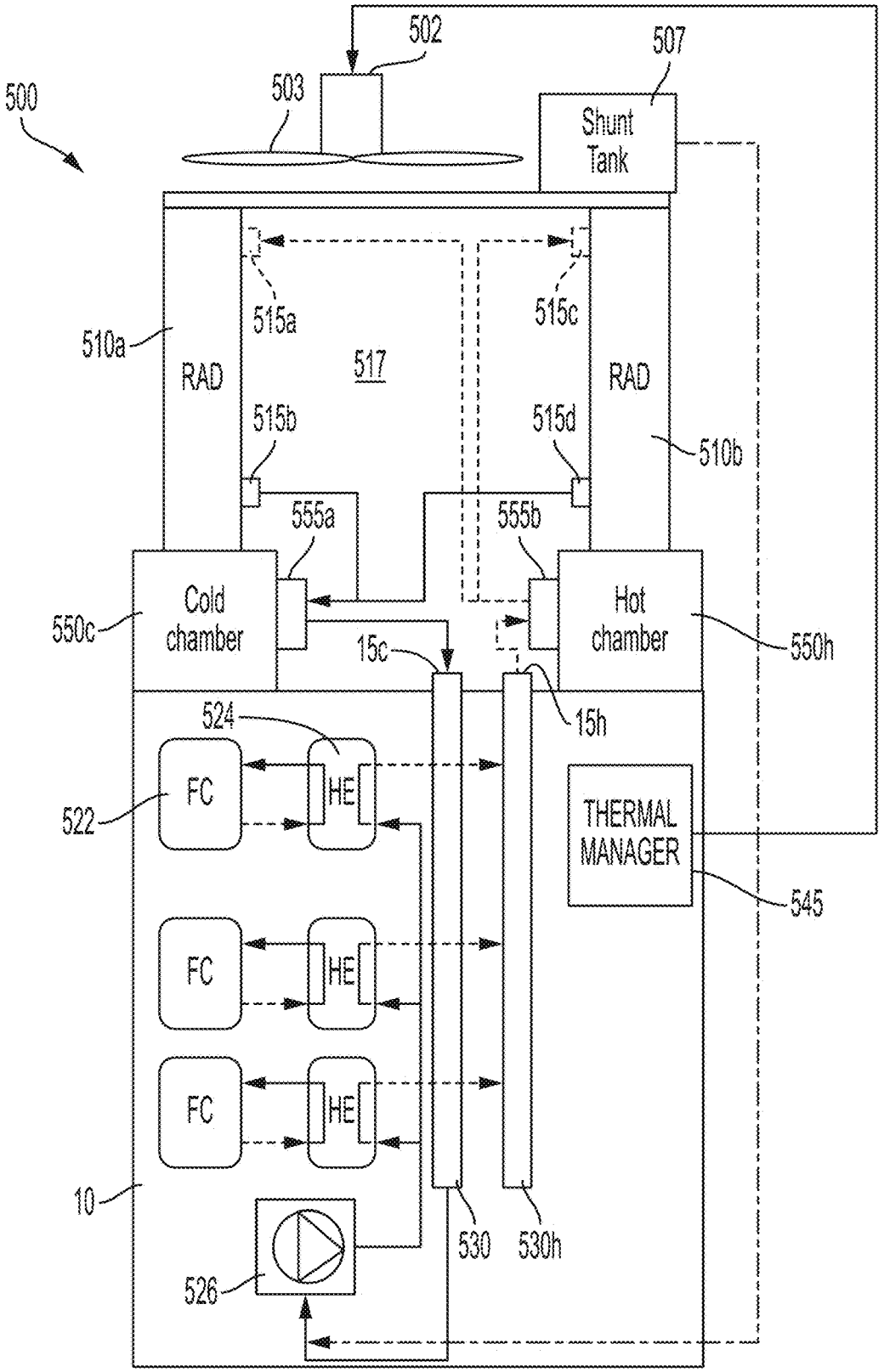
FIGS. 5A and 5B are schematic diagrams, from end view in FIG. 5A and side view in FIG. 5B, of an exemplary thermal management system by which the present inventive concept can be embodied.
Figure 5B:
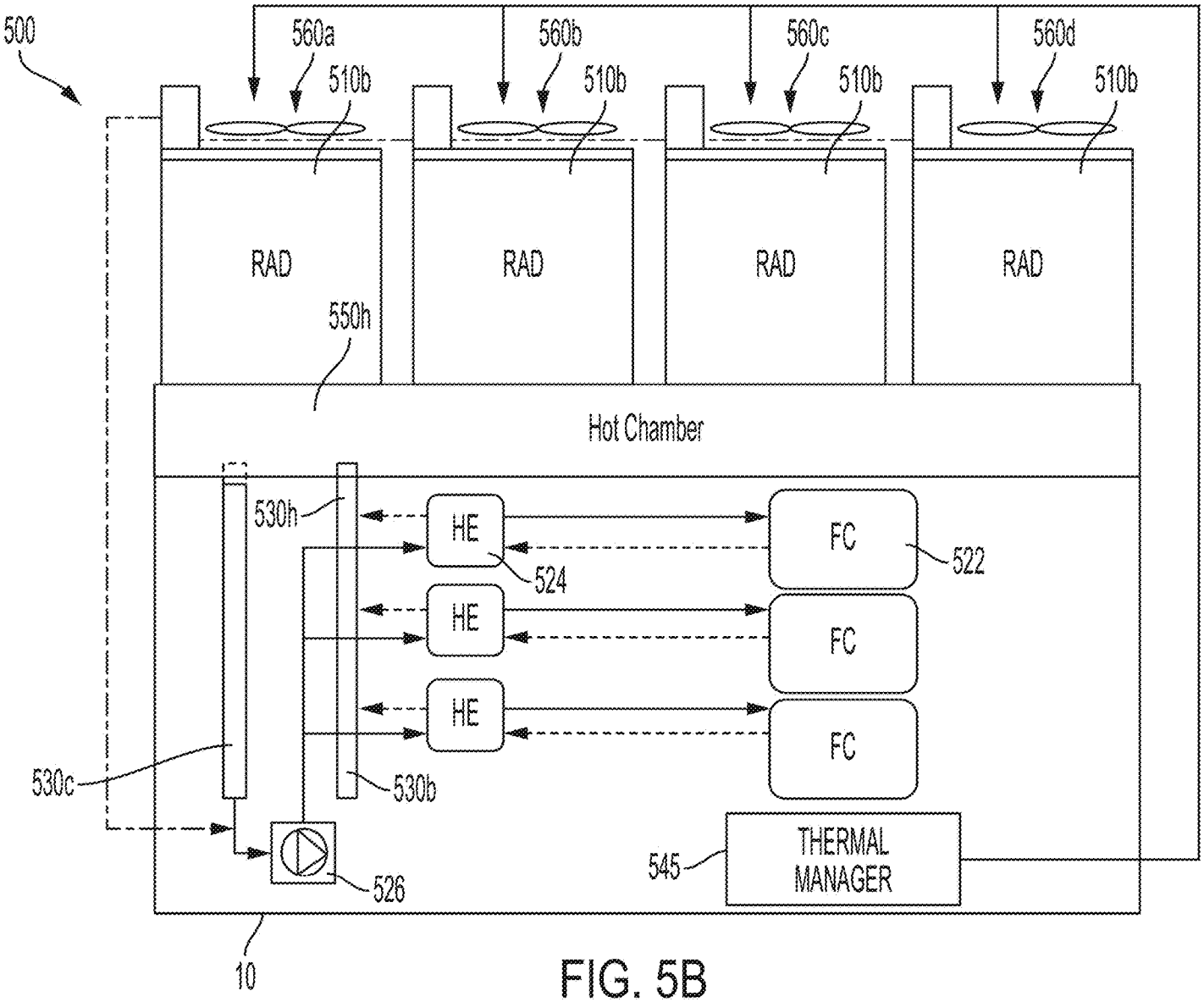

FIGS. 5A and 5B, collectively referred to herein as FIG. 5, are schematic fluid flow diagrams, from end view in FIG. 5A and side view in FIG. 5B, of an exemplary thermal management system 500 by which the present inventive concept can be embodied. FIG. 5 depicts thermal management system 500 in context of power station 10, which may be constructed to generate electrical power through, for example, a set of fuel cells, representatively illustrated at fuel cell 522. Byproduct heat produced by each fuel cell 522 may be transferred to a fluid coolant through corresponding heat exchangers, representatively illustrated at heat exchanger 524, coupled to hot and cold coolant manifolds 530*h* and 530*c*, respectively. Coolant manifolds 530*h* and 530*c* may be coupled to hot coolant port 15*h* and cold coolant port 15*c*, respectively, which, in turn, may be coupled to hot coolant chamber 550*h* in one mounting rail and cold coolant chamber 550*c* in the other mounting rail. Hot coolant ports 515*a* and 515*c* on respective radiators 510*a* and 510*b* of each cooling unit 560*a*-560*d*, representatively referred to herein as cooling unit(s) 560, may be coupled to hot chamber port 555*b* and cold coolant ports 515*b* and 515*d* on respective radiators 510*a* and 510*b* of each cooling unit 560 may be coupled to cold chamber port 555*a* through suitable conduits and connectors.

Air may be drawn through radiators 510*a* and 510*b* on each cooling unit 560 by a fan 503 that is driven by a fan motor 502. The speed of fan motor 502 may be controlled by a thermal manager component 545 constructed or otherwise configured to balance, for example, energy requirements for drawing the air through radiators 510*a* and 510*b* and the required overall cooling rate of thermal management system 100. In the illustrated embodiment, thermal manager component 545 may be a component of power station 10 that controls a coolant pump 526 and, thereby, the system coolant pressure and flow rate. Thermal manager component 545 may additionally have external electrical signal connections for a thermal management system, e.g., thermal management system 500, such as for driving fan motors 502 at a particular speed. However, the present inventive concept is not limited to this configuration.

Each cooling unit 560 may employ a shunt tank 507 containing replacement coolant for coolant loss through evaporation, system leaks, etc., but the present inventive concept is not limited to this configuration.

INDUSTRIAL APPLICABILITY

Thermal management is key to successful operation of a wide variety of machines and processes. Faulty thermal management designs can result not only in equipment failure but can also pose a fire hazard to both persons and property. Thermal management techniques that reduce complexity in their physical manifestations may consequently reduce the number of paths to system failure. Modularization of these thermal management manifestations is one way utilized by embodiments of the present inventive concept to simplify thermal management system designs. Another is to combine functionality, such as combining mounting rail functionality with coolant distribution functionality, in a single component. These inventive features are applicable over a wide range of applications that require thermal management.

The descriptions above are intended to illustrate possible implementations of the present inventive concept and are not restrictive. Many variations, modifications and alternatives will become apparent to the skilled artisan upon review of this disclosure. For example, components equivalent to those shown and described may be substituted therefore, elements and methods individually described may be combined, and elements described as discrete may be distributed across many components. The scope of the invention should therefore be determined not with reference to the description above, but with reference to the appended claims, along with their full range of equivalents.

What is claimed is:

1. A thermal management system for an exothermic process comprising:

cooling units, each including a hot coolant port through which coolant heated by the exothermic process flows and a cold coolant port through which the coolant that has been heat reduced flows;

a pair of mounting rails each having one or more interior chambers in fluid communication with coolant ports formed on the respective mounting rails; and conduits constructed to interconnect the coolant port of one of the mounting rails to the hot coolant port of each of the cooling units and the coolant port of the other one of the mounting rails to the cold coolant port of each of the cooling units, wherein each of the cooling units includes:

a support structure attached to the mounting rails, a top plate mechanically attached to the support structure and constructed to support a circulation fan, and a pair of radiators mechanically attached to the support structure on opposing sides thereof relative to the top plate, each of the radiators having a hot coolant radiator port connected to the coolant port of one of the mounting rails, and a cold coolant radiator port connected to the coolant port of the other one of the mounting rails.

2. The thermal management system of claim 1, wherein the one or more interior chambers of the mounting rails are hollow over the respective lengths of the corresponding mounting rails.

3. The thermal management system of claim 2, further comprising one or more struts lining each of the one or more internal chambers of the mounting rails and constructed to reinforce the corresponding mounting rails against compression.

4. The thermal management system of claim 3, wherein the struts have respective openings formed therein that permit coolant flow in the one or more interior chambers of the mounting rails over the respective lengths of the corresponding mounting rails.

5. The thermal management system of claim 1, wherein the mounting rails include respective mounting flanges exterior to and extending away from the one or more internal chambers of the mounting rails.

6. The thermal management system of claim 5, wherein each of the mounting rails include:

a flanged U-channel bar of which the mounting flanges and an open U-channel are formed in single piece formation; and a chamber cover attached across the open U-channel of the flanged U-channel bar to define a hollow cross-section of the one or more interior chambers of a one of the pair of mounting rails.

7. The thermal management system of claim 5, wherein the cooling units are mechanically attached to each of the mounting rails at the respective mounting flanges thereof.

8. The thermal management system of claim 5, wherein the cooling units are attached to the mounting rails with the respective radiators thereof in alignment with one another along the length of the corresponding mounting rails.

9. The thermal management system of claim 1, further comprising connectors disposed at respective ends of each of the mounting rails.

10. A thermal management system for an exothermic apparatus having a hot coolant port through which heated coolant is delivered to the thermal management system and a cold coolant port through which heat reduced coolant is delivered from the thermal management system, thermal management system comprising:

coolers constructed to transfer heat from the heated coolant delivered through the hot coolant port of the exothermic apparatus and to provide the resulting heat reduced coolant to the cold coolant port of the exothermic apparatus;

a pair of mounting rails constructed to directly support the coolers mechanically attached thereto, the mounting rails each having one or more interior chambers constructed to contain the heated coolant in one of the mounting rails and the heat reduced coolant in the other one of the mounting rails; and conduits constructed to interconnect the respective mounting rails to the corresponding hot coolant port and the cold coolant port, wherein each of the coolers includes:

a support structure to support the cooler on the mounting rails, a top plate mechanically attached to the support structure and constructed to facilitate operation of a circulation fan, and a pair of radiators mechanically attached to the support structure on opposing sides thereof relative to the top plate, each of the radiators having a hot coolant radiator port connected to the coolant port of one of the mounting rails, and a cold coolant radiator port connected to the coolant port of the other one of the mounting rails.

11. The thermal management system of claim 10, wherein the one or more interior chambers of the mounting rails are hollow over the length of the corresponding mounting rails.

12. The thermal management system of claim 11, further comprising one or more struts lining each of the one or more internal chambers of the mounting rails and constructed to reinforce the corresponding mounting rails against compression.

13. The thermal management system of claim 12, wherein the one or more struts have respective openings formed therein that permit coolant flow in the one or more interior chambers of the mounting rails over the length of the mounting rail.

14. The thermal management system of claim 10, wherein the mounting rails include respective mounting flanges exterior to and extending away from the one or more internal chambers of the mounting rails.

15. The thermal management system of claim 14, wherein each of the mounting rails include:

a flanged U-channel bar of which the mounting flanges and an open U-channel are formed in single piece formation; and a chamber cover attached across open U-channel of the flanged U-channel bar to define a hollow cross-section of the one or more interior chambers of a one of the pair of mounting rails.

16. The thermal management system of claim 14, wherein the coolers are mechanically attached to each of the mounting rails at the respective mounting flanges thereof.

17. The thermal management system of claim 14, wherein the coolers are attached to the mounting rails with the respective radiators thereof in alignment with one another along the length of the corresponding mounting rails.

18. The thermal management system of claim 10, further comprising connectors at respective ends of each of the mounting rails, the coolers being coupled to the exothermic apparatus only through the connectors on the corresponding mounting rails.

19. A thermal management system comprising:

a plurality of coolers to cool a power manager, each of the coolers including:

a hot coolant port, and a cold coolant port downstream of the hot coolant port;

a pair of mounting rails separating the power manager from the plurality of coolers, each of the mounting rails having one or more interior chambers in fluid communication with a coolant port of the corresponding mounting rail of the plurality of mounting rails;

a plurality of conduits constructed to interconnect the coolant port of one of the mounting rails to the hot coolant port of each of the coolers and the coolant port of the other one of the mounting rails to the cold coolant port of each of the coolers; and a plurality of radiators, wherein the interior chambers of the mounting rails are hollow over the respective lengths of the corresponding mounting rails and form at least respective portions of the conduits, and wherein the coolers are attached to the mounting rails with the respective radiators in alignment with one another along the length of the corresponding mounting rails.

* * * * *